United States Patent [19]

Kornbau

[11] 4,314,255

[45] Feb. 2, 1982

[54] ELECTROMAGNETIC ANGLE FILTER INCLUDING TWO STAGGERED, IDENTICAL, PERIODICALLY PERFORATED CONDUCTIVE PLATES

[75] Inventor: Thomas W. Kornbau, Poway, Calif.

[73] Assignee: General Dynamics, Electronics Division, San Diego, Calif.

[21] Appl. No.: 138,324

[22] Filed: Apr. 8, 1980

[51] Int. Cl.[3] ..... H01Q 15/10

[52] U.S. Cl. ..... 343/909

[58] Field of Search ..... 343/753, 754, 755, 756, 343/909

[56] References Cited

U.S. PATENT DOCUMENTS 4,169,268 9/1979 Schell et al. ..... 343/909

*Primary Examiner*—Eli Lieberman

*Attorney, Agent, or Firm*—Brown & Martin

[57] ABSTRACT

An angle filter for electromagnetic radiation having a predetermined wavelength λ. The angle filter includes a planar-parallel pair of perforated conductive plates having arrays of periodic perforations. The perforations are spaced apart for creating grating lobes between the plates at the predetermined wavelength λ at incidence angles greater than $\theta_G$. All of the perforations in both plates are identical. The spacing between the perforations in both plates is identical. The plates are staggered so that the perforations in at least one dimension of one plate are aligned between the perforations in the corresponding dimension of the other plate for minimizing coupling between the plates at incidence angles somewhat greater than $\theta_G$ in a plane corresponding to the one dimension. The center-to-center spacing between perforations in the one dimension is equal to λ divided by 2 sin $\theta$, wherein $\theta$ is an incidence angle greater than $\theta_G$. In an embodiment in which the plates contain the periodic perforations in two normal dimension, which define E and H-planes, the plates are staggered so that the perforations in both dimensions of one plate are aligned between the perforations in the corresponding dimensions of the other plate for minimizing coupling between the plates over a range of incidence angles in both the E and H-planes.

4 Claims, 10 Drawing Figures

ELECTROMAGNETIC ANGLE FILTER INCLUDING TWO STAGGERED, IDENTICAL, PERIODICALLY PERFORATED CONDUCTIVE PLATESBACKGROUND OF THE INVENTION

The present invention generally pertains to electronic communications systems and is particularly directed to an improvement in electromagnetic angle filters of the type including periodically perforated conductive plates.

Angle filters are useful in reducing sidelobes in incident electromagnetic radiation having a predetermined wavelength λ. Prior art angle filters including periodically perforated conductive plates have been effective in reducing sidelobes. Such plates have been employed both individually and in planar-parallel combinations. In such angle filters, however, there is a need for providing a more narrow pass band and for providing improved suppression of sidelobes.

SUMMARY OF THE INVENTION

The present invention is an improved angle filter of the type including a planar-parallel pair of perforated conductive plates having arrays of periodic perforations for filtering electromagnetic radiation having a predetermined wavelength λ. The angle filter of the present invention is characterized by all of the perforations in both plates being identical; the spacing between the perforations in both plates being identical; the perforations being spaced apart for creating grating lobes between the plates at the predetermined wavelength λ at incidence angles greater than $\theta_G$; and the plates being staggered so that the perforations in at least one dimension of one plate are aligned between the perforations in the corresponding dimension of the other plate for minimizing coupling between the plates at incidence angles somewhat greater than $\theta_G$ in a plane corresponding to the one dimension. The offset in alignment causes the contribution to coupling between the plates due to the grating lobe to cancel the coupling due to the principal propagating wave at incidence angles somewhat greater than $\theta_G$. The grating lobe must be at approximately the same incidence angle as the angle of incidence of the principal propagating wave between the plates in order to provide perfect cancellation.

$\theta_G$ is the incidence angle in free space at the onset of the grating lobe. The incidence angle is measured from the normal to the plates. $\theta_G$ may be derived from the equation:

$$\sin \theta_G = \lambda/D - \sqrt{\epsilon}, \quad (1)$$

wherein λ is the predetermined wavelength in free space; ε is the dielectric constant of the material between the plates; and D is the center-to-center spacing between the perforations in the one dimension.

In the preferred embodiment, the center-to-center spacing D is defined by the equation:

$$D = \lambda/(2 \sin \theta), \quad (2)$$

wherein θ is an incidence angle greater than $\theta_G$.

Typically the plates contain the periodic perforations in two normal dimensions which define E planes and H planes. In such an embodiment it sometimes is preferable that the plates be staggered so that the perforations in both dimensions of one plate are aligned between the perforations in the corresponding dimensions of the other plate for minimizing coupling between the plates at incidence angles greater than $\theta_G$ in both the E and H planes; and the center-to-center spacing between the perforations in each of the two normal dimensions is equal to λ divided by 2 sin θ.

The improved angle filter of the present invention may be used for providing a more narrow pass band and for providing improved suppression of sidelobes.

DESCRIPTION OF THE PREFERRED EMBODIMENT

Figure 1:
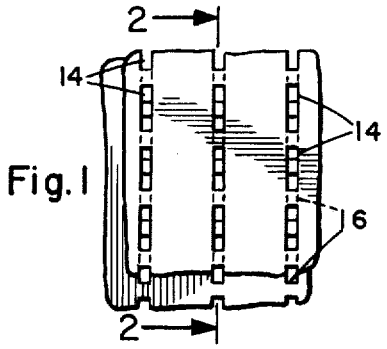
FIG. 1 is a plan view of a portion of an angle filter according to the present invention having improved filtering characteristics in the H-plane.
Figure 2:
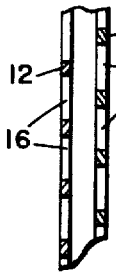
FIG. 2 is a side sectional view of the angle filter of FIG. 1 taken along line 2—2.

A preferred embodiment of the angle filter of the present invention having improved filtering characteristics in the H-plane is shown in FIGS. 1 and 2. The angle filter includes a planar-parallel pair of perforated conductive plates 10 and 12. The plates 10 and 12 have identical arrays of periodic perforations 14 and 16 respectively. The perforations 14, 16 are rectangular slots for passing linearly polarized waves. Circular perforations are provided in the plates for passing circularly polarized signals.

All of the perforations 14, 16 are identical in both shape and size. The spacing between the perforations 14 in the plate 10 is identical to the spacing between the perforations in the plate 12.

The perforations 14, 16 in the respective plates 10, 12 are spaced apart for creating grating lobes between the plates 10, 12 at the predetermined wavelength λ at incidence angles greater than $\theta_G$.

Figure 3:
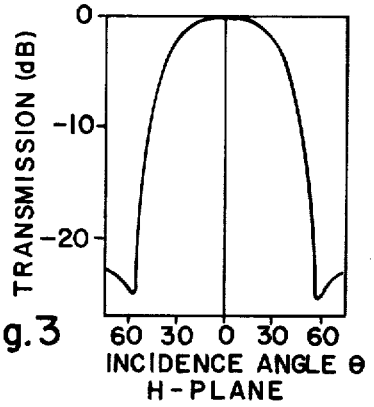
FIG. 3 is a graph illustrating transmission in the H-plane for the angle filter to FIGS. 1 and 2.

The plates 10, 12 are staggered so that the slots 14 in the plate 10 are aligned vertically between the slots 16 in the plate 12 for minimizing coupling between the plates 10 and 12 at incidence angles greater than $\theta_G$ in the H-plane. The measured transmission characteristic in the H-plane for the angle filter of FIGS. 1 and 2 is shown in FIG. 3.

Figure 4:
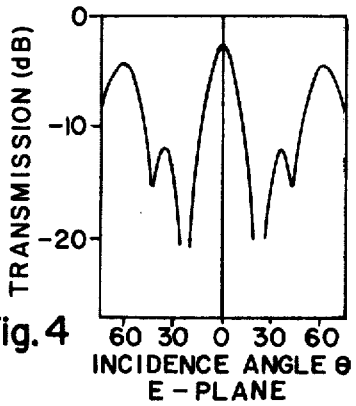
FIG. 4 is a graph illustrating transmission in the E-plane for the angle filter of FIGS. 1 and 2.

In this embodiment the slots 14 in the plate 10 are in alignment horizontally with the slots 16 in the plate 12. The measured transmission characteristic in the E-plane for the angle filter of FIGS. 1 and 2 is shown in FIG. 4.

Ideally, the slots 14 in the plate 10 are aligned so that their center positions are vertically midway between the respective center positions of the slots 16 in the plate 12. The center-to-center vertical spacing of the slots 14, 16 in both plates 10, 12 is equal to $\lambda$ divided by 2 sin $\theta$, wherein $\theta$ is an incidence angle greater than $\theta_G$ for the H-plane.

The spacing between the plates 10 and 12 is in a range of from about 0.2 $\lambda_R$ to 0.3 $\lambda_R$, wherein $\lambda_R$ is equal to the predetermined free space wavelength $\lambda$ divided by $\epsilon$, the dielectric constant of the material that is between the plates 10 and 12.

The slots 14, 16 are approximately $\lambda_R/2$ in length and $\lambda_R/10$ in width.

Figure 5:
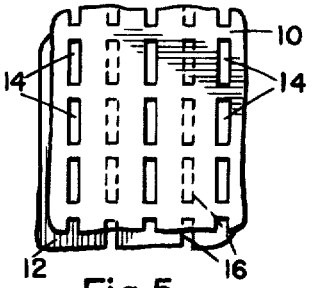
FIG. 5 is a plan view of a portion of an angle filter according to the present invention having improved filtering characteristics in the E-plane.

A preferred embodiment of the angle filter of the present invention having improved filtering characteristics in the E-plane is shown in FIG. 5. The angle filter includes a planar-parallel pair of periodically perforated conductive plates that are identical in construction to the plates 10 and 12 in the embodiment of FIGS. 1 and 2. The spacing between the plates in the FIG. 5 embodiment is also identical to the spacing between the plates 10 and 12 in the embodiment of FIGS. 1 and 2.

The angle filter of the FIG. 5 embodiment differs from the angle filter shown in FIGS. 1 and 2, only in the manner in which the plate 10 is staggered in relation to the plate 12. In the FIG. 5 embodiment, the plates 10, 12 are staggered so that the slots 16 in the plate 12 are aligned horizontally between the slots 14 in the plate 10 for minimizing coupling between the plates 10 and 12 at incidence angles greater than $\theta_G$ in the E-plane. The measured transmission characteristics in the E-plane for the angle filter of FIG. 5 is shown in FIG. 7.

In this embodiment, the slots 14 in the plate 10 are in alignment vertically with the slots 16 in the plate 12. The measured transmission characteristic in the H-plane for the angle filter of FIG. 5 is shown in FIG. 6.

Figure 6:
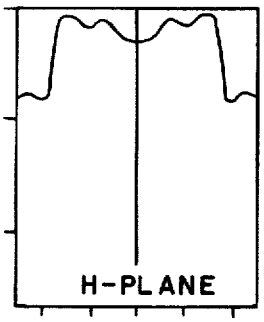
FIG. 6 is a graph illustrating transmission in the H-plane for the angle filter of FIG. 5.
Figure 7:
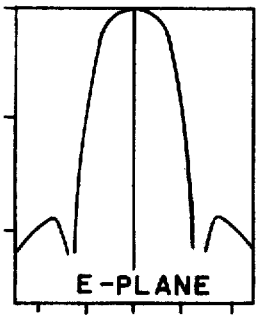
FIG. 7 is a graph illustrating transmission in the E-plane for the angle filter of FIG. 5.

The improvement provided by the angle filter of the present invention is readily observed by comparing the H-plane transmission characteristics of FIGS. 3 and 6 and by comparing the E-plane transmission characteristics of FIGS. 4 and 7.

Returning to the angle filter of FIG. 5, ideally, the slots 14 in the plate 10 are aligned so that their center positions are horizontally midway between the respective center positions of the slots 16 in the plate 12. The center-to-center horizontal spacing of the slots 14, 16 in both plates 10, 12 is equal to $\lambda$ divided by 2 sin $\theta$, wherein $\theta$ is an incidence angle greater than $\theta_G$ for the E-plane.

Figure 8:
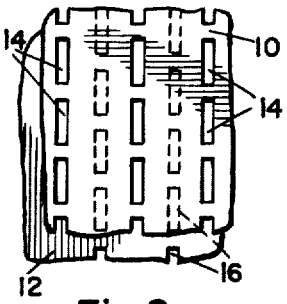
FIG. 8 is a plan view of a portion of an angle filter according to the present invention having improved filtering characteristics in both the H-plane and the E-plane.

A preferred embodiment of the angle filter of the present invention having improved filtering characteristics in both the E and H-planes is shown in FIG. 8. The angle filter includes a planar-parallel pair of periodically-perforated conductive plates that are identical in construction to the plates 10 and 12 in the embodiments of FIGS. 1 and 2 and FIG. 5. The spacing between the plates in the FIG. 8 embodiment is also identical to the spacing between the plates 10 and 12 in the embodiment of FIGS. 1 and 2.

Figure 9:
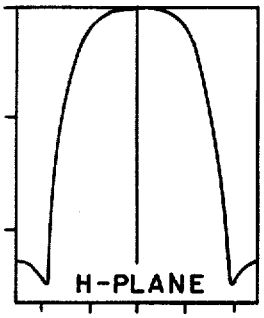
FIG. 9 is a graph illustrating transmission in the H-plane for the angle filter of FIG. 8.
Figure 10:
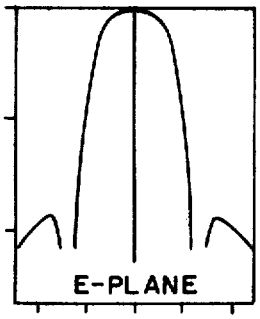
FIG. 10 is a graph illustrating transmission in the E-plane for the angle filter of FIG. 8.

In the embodiment of FIG. 8 the plates 10 and 12 are staggered so that the slots 16 in the plate 12 are aligned horizontally midway between the slots 14 in the plate 10 for minimizing coupling between the plates 10 and 12 at incidence angles greater than $\theta_G$ in the E-plane, and are aligned vertically midway between the slots 14 in the plate 10 for minimizing coupling between the plates 10 and 12 at incidence angles greater than $\theta_G$ in the H-plane. The measured transmission characteristics of the angle filter of FIG. 8 in the H-plane are shown in FIG. 9; and the measured transmission characteristics for this angle filter in the E-plane are shown in FIG. 10.

Having described my invention, I now claim:

1. An angle filter for electromagnetic radiation having a predetermined wavelength $\lambda$, comprising:

a planar-parallel pair of perforated conductive plates having arrays of periodic perforations;

characterized by all of the perforations in both plates being identical;

the spacing between the perforations in both plates being identical;

the perforations being spaced apart for creating grating lobes between the plates at the predetermined wavelength $\lambda$ at incidence angles greater than $\theta_G$; and the plates being staggered so that the perforations in at least one dimension of one plate are aligned between the perforations in the corresponding dimension of the other plate for minimizing coupling between the plates at incidence angles somewhat greater than $\theta_G$ in a plan corresponding to the one dimension.

2. An angle filter according to claim 1, characterized by the center-to-center spacing between perforations in the one dimension being equal to $\lambda$ divided by 2 sin $\theta$, wherein $\theta$ is an incidence angle greater than $\theta_G$.

3. An angle filter according to claim 1, wherein the plates contain said periodic perforations in two normal dimensions defining E-planes and H-planes, characterized by the plates being staggered so that the perforations in both dimensions of one plate are aligned between the perforations in the corresponding dimensions of the other plate for minimizing coupling between the plates at incidence angles somewhat greater than $\theta_G$ in both the E and H-planes.

4. An angle filter according to claim 3, characterized by the center-to-center spacing between perforations in each of the two normal dimensions being equal to $\lambda$ divided by 2 sin $\theta$, wherein $\theta$ is an incidence angle greater than $\theta_G$ for the respective dimension.

* * * * *